US007500875B2

(12) United States Patent
Lamdiziz et al.

(10) Patent No.: US 7,500,875 B2
(45) Date of Patent: Mar. 10, 2009

(54) CONTACT HOUSING FOR AN ELECTRICAL PLUG CONNECTION

(75) Inventors: Mohamed Lamdiziz, Marbach (DE); Eckhardt Philipp, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 17 days.

(21) Appl. No.: 11/803,792

(22) Filed: May 15, 2007

(65) Prior Publication Data

US 2007/0275609 A1 Nov. 29, 2007

(30) Foreign Application Priority Data

May 15, 2006 (DE) ..... 10 2006 022 488

(51) Int. Cl.
*H01R 13/40* (2006.01)

(52) U.S. Cl. ..... 439/595

(58) Field of Classification Search ..... 439/595, 439/744, 752, 871
See application file for complete search history.

(56) References Cited

U.S. PATENT DOCUMENTS 5,326,287 A * 7/1994 Hamakita et al. ..... 439/752
5,697,812 A * 12/1997 Sampson et al. ..... 439/567
5,743,008 A * 4/1998 Endo et al. ..... 29/842
5,857,876 A * 1/1999 Hatagishi ..... 439/752
6,036,553 A * 3/2000 Seko et al. ..... 439/752
6,497,591 B2 * 12/2002 Fujita ..... 439/752
6,655,999 B2 * 12/2003 Mase et al. ..... 439/752
6,780,070 B2 * 8/2004 Ishikawa et al. ..... 439/752
6,805,592 B2 * 10/2004 Kurimoto ..... 439/752
6,835,102 B2 * 12/2004 Kayama ..... 439/686
7,125,292 B2 * 10/2006 Horiuchi et al. ..... 439/752
2002/0193011 A1 * 12/2002 Mase et al. ..... 439/752
2004/0132351 A1 * 7/2004 Miyakawa et al. ..... 439/752

* cited by examiner

*Primary Examiner*—Renee Luebke
*Assistant Examiner*—Larisa Tsukerman
(74) *Attorney, Agent, or Firm*—Kenyon & Kenyon LLP

(57) ABSTRACT

A contact housing for an electrical plug connection, having a plurality of contact chambers for accommodating in each case a contact element that is able to be plugged into the contact chamber through an assembly opening, having in each case a latching element, that extends laterally into the contact chamber, for the primary latching of the contact element which is pushed, up to its end position, into the contact chamber, and having in each case a locking element that is guided shiftably transversely to the plug-in direction of the contact element between two adjacent contact chambers, for the secondary locking of the contact element that is primarily latched in the one contact chamber, the locking element laterally extending into the one contact chamber using a locking projection in the locking position, and forming a guidance area of the other contact chamber on its side facing away from the locking projection. The guidance area of the locking element extends farther in the plug-in direction than the locking projection, and forms a contact area for a contact element that is primarily latched in the other contact chamber.

9 Claims, 5 Drawing Sheets

PRIOR ART

PRIOR ART

CONTACT HOUSING FOR AN ELECTRICAL PLUG CONNECTION

FIELD OF THE INVENTION

The present invention relates to a plug housing for an electrical plug device.

BACKGROUND INFORMATION

At this time, in the automotive field, contact systems are used in electrical plug connections in which the individual contacts are attached to the electrical lines in a first working step, and in a second working step the plug is latched in the contact chamber. In this connection, essentially two primary latching mechanisms are used. In the so-called "lance contacts", flexible metallic elements of the contact latch in recesses or undercuts in the contact chamber. In the so-called "clean body contacts", elements of the contact chamber spring in recesses or undercuts of the contacts and in this manner latch to the contacts. In multi-part chamber systems, two latching types are known for clean body contacts. In multi-part chamber systems, two latching types are known for clean body contacts. The first latching type is characterized in that the latching arm is linked to the contact chamber wall at the height of the contact shoulder, and the latching hook engages in a contact undercut, near the contact opening. The latching arm grows, as it were, in the plug-in direction and when it stops, it is essentially stressed axially by pressure. The second latching type is characterized in that the latching arm is linked to the contact chamber wall at the height of the contact shoulder, and the latching hook reaches over the contact shoulder or engages in a corresponding opening near the contact shoulder. The latching arm grows, as it were, opposite to the plug-in direction and when it stops, it is essentially stressed in tension. In both cases the latching arms with their latching hooks are usually extruded with their latching hooks in the contact carrier lower part as parts of the contact chamber walls. Making available the latching hooks is only one task of the contact chamber in the contact carrier lower part. The part of the contact chamber in the contact carrier lower part should, in addition, guide contacts through chamber walls, and thereby ensure a correct clearance of the contacts. In addition, the contact chamber should form the plug-in funnel for the contact pins of the matching side. The technical requirements for stable latching hooks, secure contact guides and a stable plug-in funnel run counter to present customer requirements for ever smaller contact clearances at contact sizes that remain the same or are even increasing. At this time, there are limits to further closer approach to each other of the contact chambers from an extrusion and mold release technology point of view, since both the wall thickness of the injection tools and the plastic wall thickness have been carried to the limit.

In the contact chambers of multi-pole plug connections, usually the primarily latched contacts are checked additionally by a so-called secondary locking with respect to their correct position in the contact chamber, and if the primary latching fails, they are additionally secured at their correct insertion depth. In multi-pole contact connections, in this instance, in many cases so-called premounted and transversely shiftable secondary locking plates are used, which, in a prelatched position, first permit the unhindered assembling of the contacts all the way into the contact chambers, and which then, at the end of the assembling procedure, are shifted by at least one-half contact chamber width transversely to the contact chamber axes. Using their locking projections that project laterally into the contact chambers, the secondary locking plates, in this context, on the one hand elicit information on the correct depth of insertion of the contacts, and, on the other hand, ensure additional locking.

SUMMARY OF THE INVENTION

It is an object of the present invention to provide a contact housing in such a way that even smaller contact clearances are able to be implemented, in multi-pole and in multi-row plug connections, having multi-part contact chambers, than is currently possible from an extrusion and unmolding technology point of view.

According to the present invention, guidance tasks of the contact chambers are transferred to the locking elements, whereby one gains free space for the design of the primary latching elements and the plug-in funnel. The formation of the chamber wall is at least partially transferred to the locking elements, and because of this, lower contact clearances are achieved, than up to now, in multi-pole and multi-row plug connections having multi-part contact chambers. Because of the present invention, it is possible to reduce the distance between two contact chambers to the space that the latching arm requires to avoid the incoming contact. An additional wall in the back of the latching arm is no longer necessary to hold the contact to a tight tolerance. Thus it is possible to do without a full separating wall between two contact chambers. The contact can be sufficiently positioned and maintained between the latching arm on the one side and the guidance surface of the locking element in the region of the contact shoulder on the other side. It is especially possible in that way to create an interrupted wall surface for supporting the contact which could not be implemented in a single component by extrusion and unmolding technology.

The contact housing according to the present invention is particularly suitable for the development of a stable contact chamber wall when designing latching hooks for clean body contact systems, in which the contacts are situated adjacently in narrow rows, and whose contacts are additionally ensured by secondary locking plates that are premounted and transversely shiftable.

DETAILED DESCRIPTION

Figure 1:
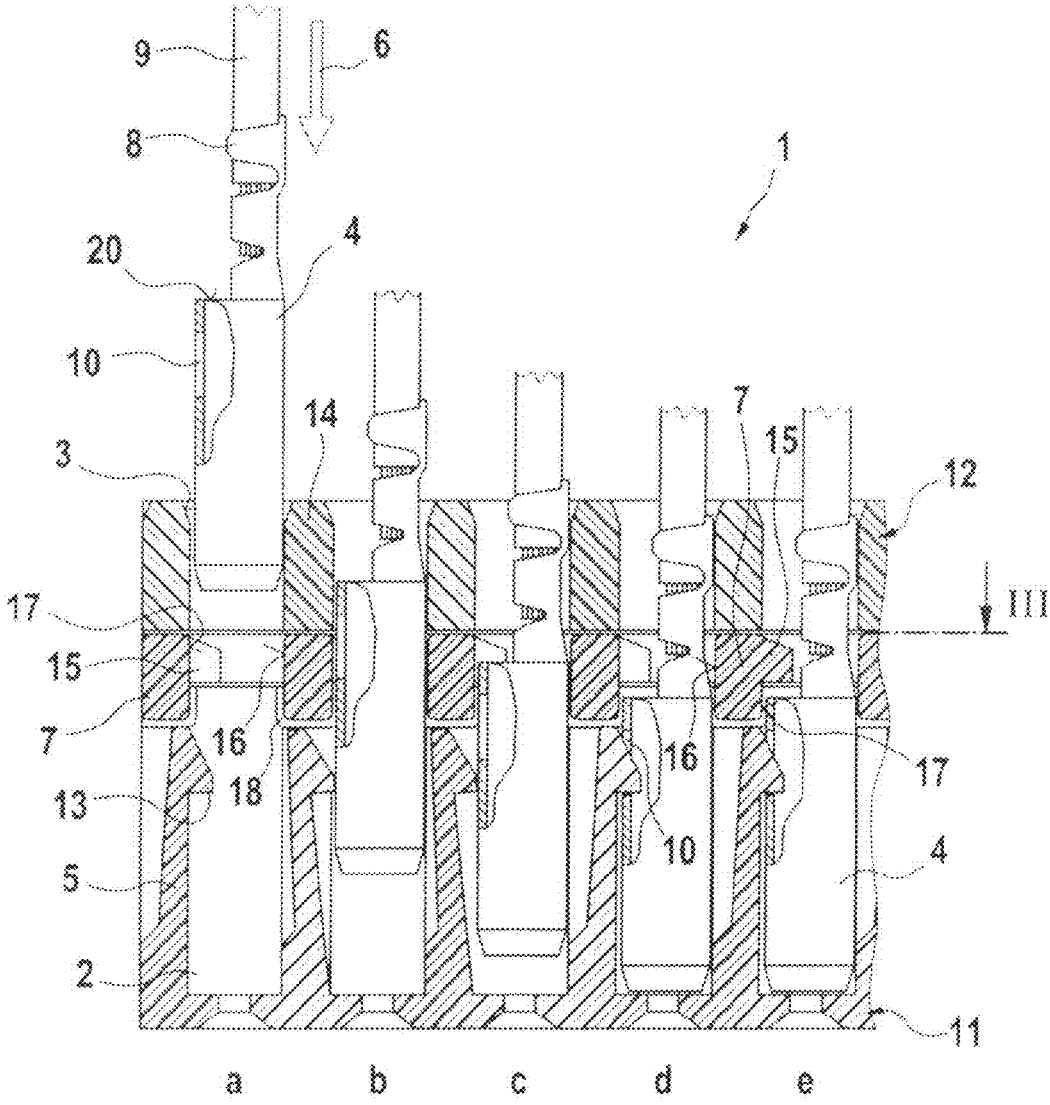
FIG. 1 shows a first specific embodiment of the contact housing according to the present invention, having a plurality of contact chambers and having contacts which are inserted into the contact chambers, each to a different distance, and are primarily latched therein and secondarily locked, in a longitudinal section.

Contact housing 1, shown in FIG. 1, for an electrical plug connection, includes five adjacently situated rows a-e of contact chambers 2 for accommodating in each case a contact element (contact) 4 that is able to be plugged through an assembly opening 3 into contact chamber 2, in each case one latching arm 5 for the primary latching of contact element 4 that is plugged in up to its end position into contact chamber 2, and in each case one locking element 7 that is guided shiftably, transversely to plug-in direction 6 of contact element 4 between two adjacent contact chambers 2, for the secondary locking of contact element 4 that is primarily latched in the one contact chamber 2.

Contact element 4 has a crimped region (clamped region) 8, to which a section of an electric line 9 is firmly connected, and, without the crimped region 8, it has a rectangular cross section. In a sidewall of contact element 4 a latching recess 10 is provided.

Locking element 7 is guided between a lower housing part 11 and an upper housing part 12 in a shiftable manner. Latching arm 5 is formed integral with lower housing part 11 and extends between two contact chambers 2 counter to plug-in direction 6. At its elastically deflectable free end, latching arm 5 has a latching hook 13, which penetrates laterally into the one contact chamber 2, the right one of the two in FIG. 1. In lower housing part 11, right and left contact chambers 2 are bordered by latching arm 5, on the side in each case. In upper housing part 12, between right and left contact chamber 2, a separating wall 14 is provided in each case.

Locking element 7 projects, in its locking position, with a locking projection 15 laterally into the right contact chamber respectively, and releases contact chamber 2 for plugging in a contact element 4 in a transversely shifted release position. In rows a-d of FIG. 1, locking elements 7 are shown in each case in the release positions, and in row e in the locking position. On its left side that faces away from locking projection 15, locking element 7 forms a guidance area 16, in left contact chamber 2 in each case, for a contact element 4 which extends farther in plug-in direction 6 than locking projection 15, and therefore forms a contact surface for contact element 4 that is primarily latched in left contact chamber 2, as is shown in FIG. 1 for rows d and e. On its right side, facing locking projection 15, locking element 7 also forms a guidance area 17 in the respectively right contact chamber 2 for a contact element 4, which extends, in plug-in direction 6, farther than locking projection 15 and forms a contact surface for contact element 4 that is primarily latched in right contact chamber 2, as is shown in FIG. 1 for rows d and e. The two guidance areas 16, 17 of locking element 7 are each aligned with separating wall 14, and are formed by a guiding projection (guiding spring), by which locking element 7 is guided, transversely shiftable, in a guiding recess 18 of lower housing part 11.

Figure 2:
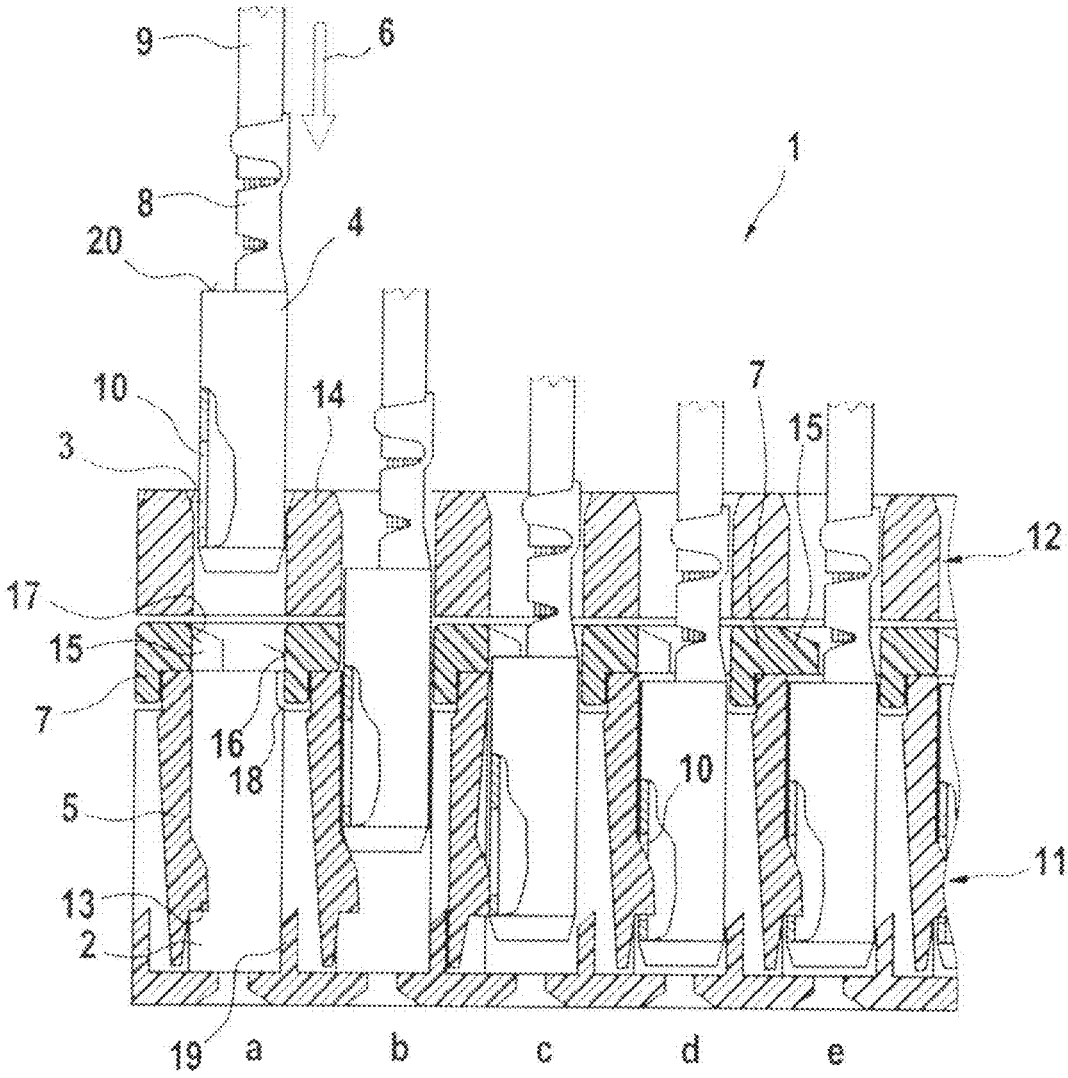
FIG. 2 shows a second specific embodiment of the contact housing according to the present invention, having a plurality of contact chambers and having contacts which are inserted into the contact chambers, each to a different distance, and are primarily latched therein and secondarily locked, in a longitudinal section.

Contact housing 1 shown in FIG. 2 differs from the contact housing of FIG. 1 only in that, in this case, latching arm 5 extends in plug-in direction 6 and in that the right guidance area 17 of locking element 7 extends in plug-in direction 6 no farther than locking projection 15. Left guidance area 16 is formed by a one-sided guidance shoulder (guidance spring) by which locking element 7 is guided transversely shiftably in guidance recess 18 of lower housing part 11. In addition, on the floor of contact chamber 2, a short separating wall 19 is provided in each case, which borders contact chamber 2 on the right-hand side.

The assembling of the two contact housings 1, shown in FIGS. 1 and 2, with contact elements 4 will be described below with the aid of rows a to e, which respectively show the progress in time of the equipping procedure.

Row a shows locking element 7 in its release position, and contact element 4 is plugged into contact chamber 2 through assembly opening 3 of upper housing part 12 and between separating walls 14. In row b, by being plugged in deeper, contact element 4 is guided also between locking element 7 and run up onto latching hook 13. In row c, because of farther plugged in contact element 4, latching arm 5 is elastically deflected until, by further plugging-in, latching hook 13 finally engages with or latches with latching recess 10 of contact element 4 (row d). Now locking element 7 is transversely shifted into its locking position, in which locking projection 15 engages a shoulder 20 of contact element 4 from behind in plugging-in direction 6, and thus contact element 4 is locked in counter to plugging-in direction 6 (row e).

Primarily latched contact element 4 of rows d and e, in the areas of their shoulders 20, are precisely positioned laterally in each case between guidance areas 16, 17 of two locking elements 7, and at the other end, in the case of FIG. 2, between a latching arm 5 and short separating wall 19. The minimum distance between two contact chambers 2 is specified by the space the latching arm 5 requires in order to evade incoming contact element 4, that is, the width of latching arm 5.

Figure 3A:
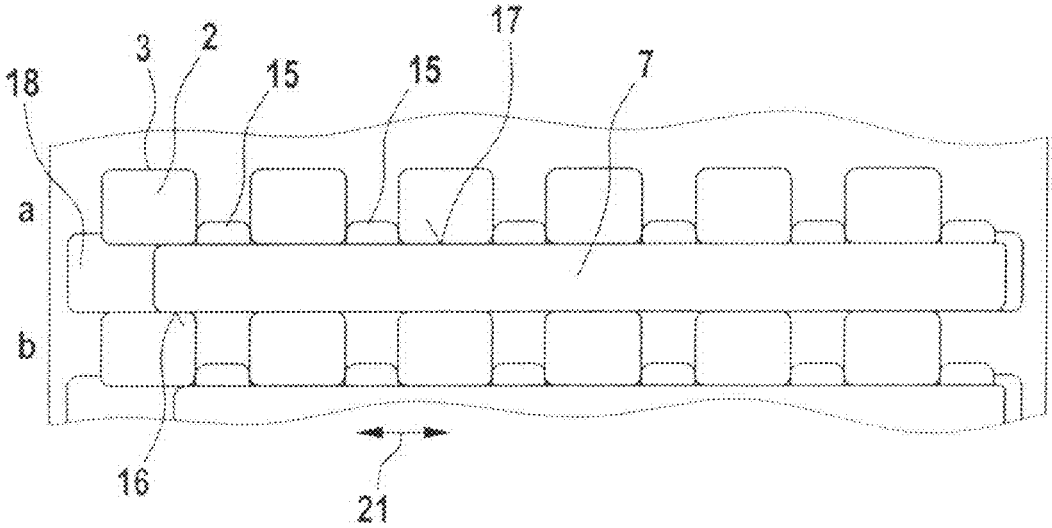
FIGS. 3*a* and 3*b* show a sectional view of the contact housing shown in FIG. 1 along III in FIG. 1, in a release position (FIG. 3*a*) and a locking position (FIG. 3*b*) of the locking element.
Figure 3B:
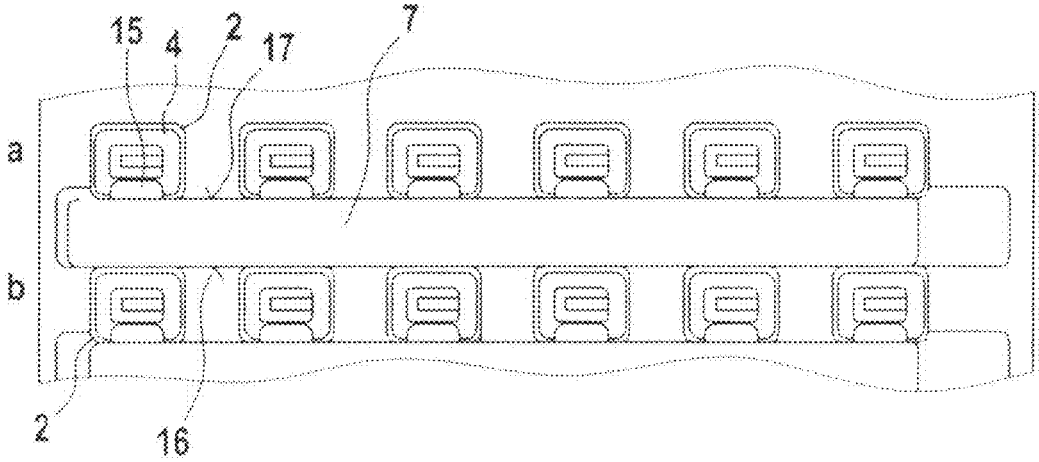

Each of rows a-e has several contact chambers 2, in FIGS. 3*a* and 3*b*, for example, two rows a, b each having six contact chambers 2 being shown. For each row, a locking element 7 is provided, which is guided transversely shiftably (double arrow 21) along the row in guidance recess 18 of lower housing part 12 and which has a locking projection 15 for each contact chamber 2. At the end of the assembly procedure, locking element 7 is shifted from its release position, shown in FIG. 3*a*, by one-half contact chamber width transversely to the contact chamber axes into the locking position shown in FIG. 3*b*. Thus, using their locking projections 15, locking elements 7 on the one hand elicit information on the correct plug-in depth of contact elements 4 and, on the other hand, ensure additional (secondary) locking.

Instead of individual locking elements for each row, in multi-pin plug connectors in many cases so-called premounted and transversely shiftable secondary locking plates are used which, in the release position, first of all permit the unhindered assembling of the contact elements into the contact chambers, and then, at the end of the assembling procedure, are shifted into their locking position by one-half of a contact chamber width, transversely to the contact chamber axes.

Figure 4:
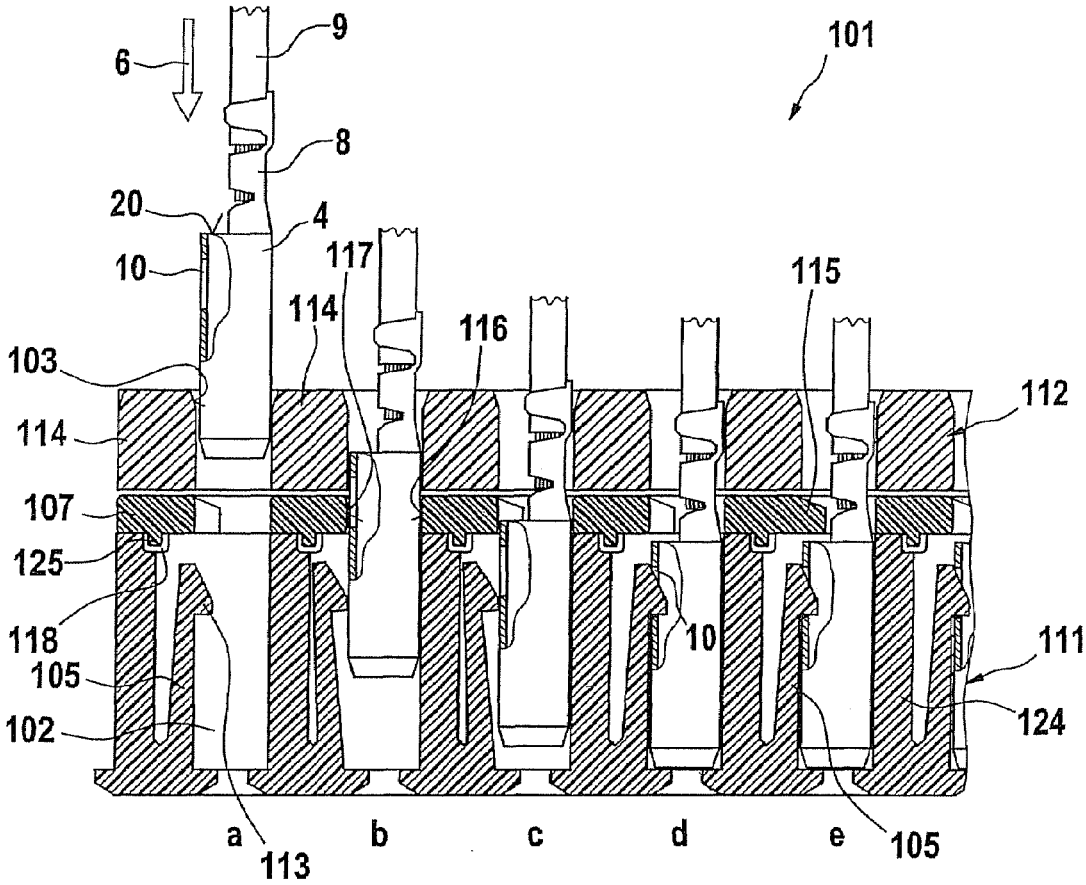
FIG. 4 shows a first specific embodiment of a contact housing known from the related art, having a plurality of contact chambers and having contacts which are inserted into the contact chambers, each to a different distance, and are primarily latched therein and secondarily locked, in a longitudinal section.
Figure 5:
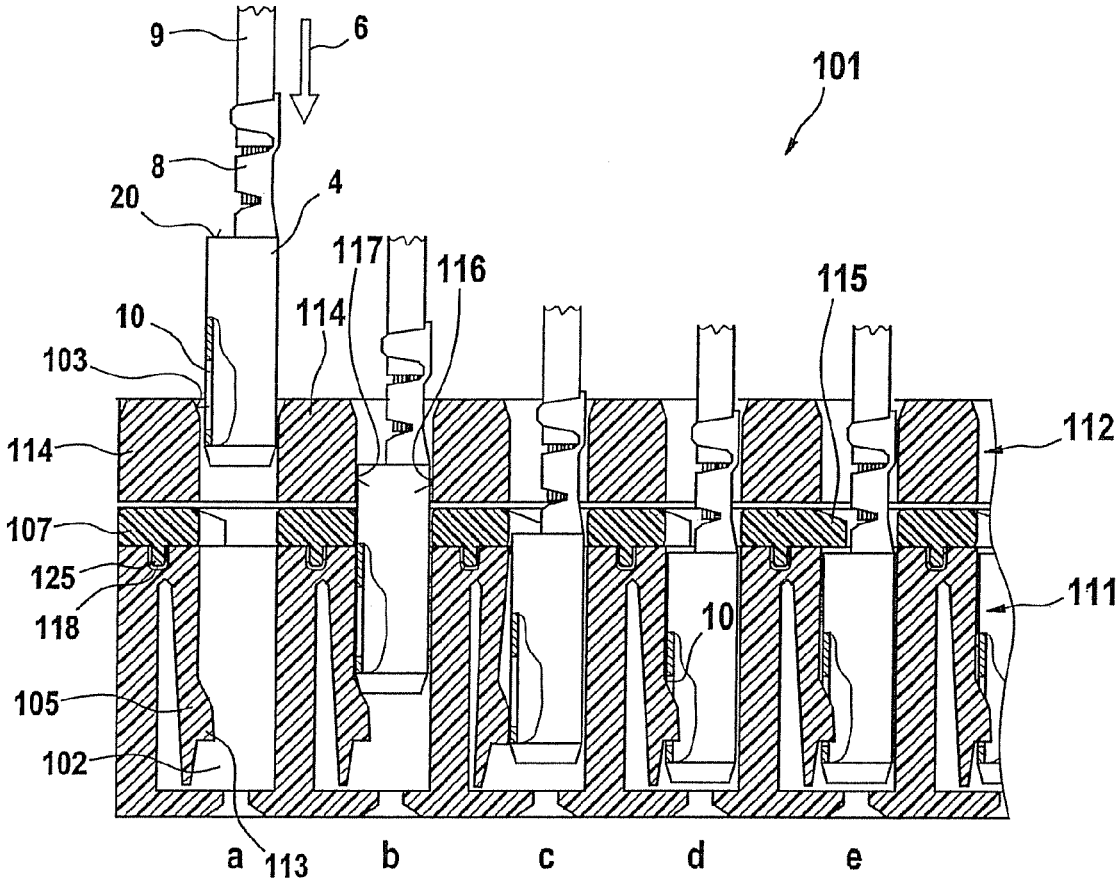
FIG. 5 shows a second specific embodiment of a contact housing known from the related art, having a plurality of contact chambers and having contacts which are inserted into the contact chambers, each to a different distance, and are primarily latched therein and secondarily locked, in a longitudinal section.

FIGS. 4 and 5 show two contact housings known from the related art. The assembling of the two contact housings 101, shown in FIGS. 4 and 5, with contact elements 4 will be described below with the aid of rows a to e, which respectively show the progress in time of the assembling procedure.

Row a shows locking element 107 in its release position, and contact element 4 is plugged into contact chamber 102 through assembly opening 103 and between separating walls 114 of upper housing part 112. In row b, by being plugged in deeper, contact element 4 is now guided also between guidance areas 116, 117 of two locking elements 107 and run up onto latching hook 113. In row c, because of farther plugged-in contact element 4, latching arm 105 is elastically deflected until, by further plugging-in, latching hook 113 finally engages with or latches with latching recess 10 of contact element 4 (row d). Now locking element 107 is transversely shifted into its locking position, in which locking projection 115 engages shoulder 20 of contact element 4 from behind in plug-in direction 6, and thus contact element 4 is locked in counter to plug-in direction 6 (row e).

Primarily latched contact element 4 of rows d and e are laterally guided in contact chamber 102 along its entire length between latching arm 105 and a separating wall 124 of lower housing part 111, and are thus precisely positioned. The minimum distance between two contact chambers 102 is specified by the space required by latching arm 105 to evade incoming contact element 4, that is, by the width of latching arm 105 as well as by the thickness of separating wall 124. Locking elements 107 have in each case a centrical guidance spring 125, which is guided transversely shiftably between lower housing part 111 and upper housing part 112 in a flat guidance groove 118 of lower housing part 111.

What is claimed is:

1. A contact housing for an electrical plug connection, comprising:

a plurality of contact chambers for accommodating in each case a contact element that is able to be plugged into the contact chamber through an assembly opening;

latching elements that extend in each case laterally into the contact chamber, for a primary latching of the contact element which is pushed, up to its end position, into the contact chamber; and locking elements that, in each case, are shiftably guided transversely to a plug-in direction of the contact element between two adjacent contact chambers, for a secondary locking of the contact element that is primarily latched in the respective contact chamber, the locking element laterally extending into the respective contact chamber using a locking projection in a locking position, and forming a guidance area of the other contact chamber on its side facing away from the locking projection, the guidance area of the locking element extending farther in the plug-in direction than the locking projection, and forming a contact surface for a contact element that is primarily latched in the other contact chamber.

2. The contact housing according to claim 1, wherein the locking element has a guidance area of the contact chamber also on a side of the locking projection, which extends farther than the locking projection in the plug-in direction, and forms a contact area for a contact element that is primarily latched in the contact chamber.

3. The contact housing according to claim 1, wherein the latching element is an elastically deflectable latching arm, for the primary latching of the contact element, which extends between the two adjacent contact chambers in the plug-in direction or counter to the plug-in direction.

4. The contact housing according to claim 3, wherein the latching arm laterally borders the two adjacent contact chambers.

5. The contact housing according to claim 3, wherein a distance between the two adjacent contact chambers is equivalent to a width of the latching arm.

6. The contact housing according to claim 1, further comprising a separating wall situated between the two adjacent contact chambers.

7. The contact housing according to claim 6, wherein the separating wall is aligned with at least one guidance area of the locking element.

8. The contact housing according to claim 1, wherein the locking element is situated between a lower housing part and an upper housing part.

9. The contact housing according to claim 8, wherein the locking element is guided in the lower housing part.

* * * * *